US008125369B1

(12) United States Patent
Kang et al.

(10) Patent No.: US 8,125,369 B1
(45) Date of Patent: Feb. 28, 2012

(54) MODULAR RCS AND IR SIGNATURE GENERATION DEVICE AND DECEPTION METHOD TO ENHANCE SUSCEPTIBILITY OF NAVAL VESSELS

(75) Inventors: Hee-Jin Kang, Gyeryong (KR); Dong-Kon Lee, Daejeon (KR)

(73) Assignee: Korea Maritime & Ocean Engineering Research Institute, Daejeon (KR)

( * ) Notice: Subject to any disclaimer, the term of this patent is extended or adjusted under 35 U.S.C. 154(b) by 0 days.

(21) Appl. No.: 13/050,148

(22) Filed: Mar. 17, 2011

(30) Foreign Application Priority Data

Mar. 15, 2011 (KR) ..... 10-2011-0023032

(51) Int. Cl.
*H01Q 15/00* (2006.01)

(52) U.S. Cl. ..... 342/10; 342/5; 342/7; 342/8; 342/9

(58) Field of Classification Search ..... 342/5, 7–10
See application file for complete search history.

(56) References Cited

U.S. PATENT DOCUMENTS

| | | | | | |
|---|---|---|---|---|---|
| 2,534,716 | A | * | 12/1950 | Hudspeth et al. | 441/20 |
| 4,546,983 | A | * | 10/1985 | Rosa | 273/348.1 |
| 4,659,089 | A | * | 4/1987 | Rosa | 273/348.1 |
| H308 | H | * | 7/1987 | Tutin et al. | 342/4 |
| H679 | H | * | 9/1989 | Czajkowski, Jr. | 342/13 |
| H694 | H | * | 10/1989 | Czajkowski, Jr. | 342/13 |
| 4,970,516 | A | * | 11/1990 | Nicolson | 342/13 |
| 4,980,688 | A | * | 12/1990 | Dozier, Jr. | 342/9 |
| 5,092,244 | A | * | 3/1992 | Giglia | 102/293 |
| 5,122,400 | A | * | 6/1992 | Stewart | 428/34.7 |
| 5,129,323 | A | * | 7/1992 | Park | 102/293 |
| 5,238,406 | A | * | 8/1993 | Littell, III | 434/21 |
| 5,249,527 | A | * | 10/1993 | Schwind | 102/354 |
| 5,398,032 | A | * | 3/1995 | Tucker et al. | 342/9 |
| 5,424,741 | A | * | 6/1995 | Genovese | 342/10 |
| 5,493,993 | A | * | 2/1996 | Carter et al. | 114/312 |
| 5,814,754 | A | * | 9/1998 | Mangolds | 89/1.11 |
| 6,384,764 | B1 | * | 5/2002 | Cumberland | 342/8 |
| 6,507,307 | B1 | * | 1/2003 | Huber, Jr. | 342/9 |
| 6,570,545 | B1 | * | 5/2003 | Snow et al. | 343/915 |
| 2004/0227657 | A1 | * | 11/2004 | Atar | 342/10 |

FOREIGN PATENT DOCUMENTS

JP 2001-263995 A 9/2001

* cited by examiner

*Primary Examiner* — Thomas Tarcza
*Assistant Examiner* — Peter Bythrow

(57) ABSTRACT

A modular RCS (Radar Cross Section) and IR (Infra-Red) signal generation device includes: a plastic bag which is normally stored in a folded state, and inflated when gas is introduced into the bag as desired; a radar reflector received in the plastic bag, the radar reflector being configured in a multi-hedral reflector structure having a reflection characteristic similar to that of a naval vessel to be protected; hot air tubes formed through the plastic bag, hot air being capable of generating IR signals by flowing through the hot air tubes; and connection patches positioned on one of the surfaces of the plastic bag at the points where the ends of the hot air tubes intersect with the surfaces, respectively, the connection patches being adapted to be attached to those of adjacent modular RCS and IR signal generation devices, respectively, so as to interconnect the hot air tubes with those of the adjacent modular RCS and IR signal generation devices.

13 Claims, 5 Drawing Sheets

MODULAR RCS AND IR SIGNATURE GENERATION DEVICE AND DECEPTION METHOD TO ENHANCE SUSCEPTIBILITY OF NAVAL VESSELS

BACKGROUND OF THE INVENTION

1. Field of the Invention

The present invention relates to a modular radar cross section (RCS) and infrared (IR) signal generation device and a method of deceiving a threat to reduce susceptibility of a naval vessel.

2. Description of the Prior Art

Recently acquired naval vessels have a tendency to be large in scale and utilize high-technology, by which the price of the Korean navy's Aegis-class naval vessel named "Sejong the Great" is so high that the price of a single vessel exceeds one trillion Korean won. However, while the probability of a full-scale war is reduced, threats of terror or small scale provocations against naval vessels are continuously increased, and hence the risk of expensive naval vessels falling victim to low-priced detection and weapon systems is continuously increased.

High-technology surveillance and control systems in modern naval battles have been developed to such a level that such systems can determine the scale and type of an enemy's naval vessel. Therefore, with only a large RCS (Radar Cross Section) signal or IR (Infrared) signal generation system, there is a limit in effectively deceiving an enemy's detection systems or weapons of intimidation and in protecting maneuvering vessels of friendly naval forces.

Such a prior art technology has been proposed in Japanese Laid-open Patent Publication No. 2001-263995 entitled "Ship Defense System." However, since the technology of the prior art merely generates large RCS signals using a radar reflector, or generates IR signals using a heater, there is a limit in deceiving an enemy's high-technology detection systems and intimidation weapon systems with only the technology.

SUMMARY OF THE INVENTION

Accordingly, the present invention has been made to solve the above-mentioned problems occurring in the prior art, and an object of the present invention is to provide a technology capable of effectively deceiving an enemy's high-technology surveillance and control systems, wherein considering that the RCS and IR signal emission patterns of each naval vessel or ship are different from those of other naval vessels or ships, the present invention configures an RCS and IR signal generation device in a module type which enables easy analysis of RCS and IR signals, and the present invention combines and interconnects a plurality of such unit modules to suitably simulate previously analyzed RCS and IR signal emission patterns of a real naval vessel so as to effectively deceive an enemy's high-technology surveillance and control systems.

In order to accomplish this object, there is provided a modular RCS (Radar Cross Section) and IR (Infra-Red) signal generation device including: a plastic bag which is normally stored in a folded state, and inflated when gas is introduced into the bag as desired; a radar reflector received in the plastic bag, the radar reflector being configured in a multihedral reflector structure having a reflection characteristic similar to that of a naval vessel to be protected; hot air tubes formed through the plastic bag, hot air being capable of generating IR signals by flowing through the hot air tubes; and connection patches positioned on one of the surfaces of the plastic bag at the points where the ends of the hot air tubes intersect with the surfaces, respectively, the connection patches being adapted to be attached to those of adjacent modular RCS and IR signal generation devices, respectively, so as to interconnect the hot air tubes with those of the adjacent modular RCS and IR signal generation devices.

In accordance with another aspect of the present invention, there is provided a method of deceiving a threat to reduce the susceptibility of a naval vessel using a modular RCS and IR signal generation device, including: analyzing RCS and IR signal emission patterns of a naval vessel to be protected (step S10); combining a plurality of modular RCS and IR signal generation devices to simulate the RCS signal emission patterns of the naval vessel to be protected (step S20); and introducing hot air through hot air tubes to simulate the IR signal emission patterns of the naval vessel to be protected (step S30).

According to the present invention, merely by combining simple shape modules, it is possible to simulate RCS and IR signals emitted by any type of naval vessel to be similar to those of a real naval vessel within a very short period of time. In addition, if variously developed RCS and IR analysis codes are used, it is possible to easily produce a combining method of modules for simulating real RCS and IR signal emission patterns of various naval vessels, whereby the safety of a large naval vessel of friendly naval forces can be effectively secured in a state in which the naval vessel confronts an enemy.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
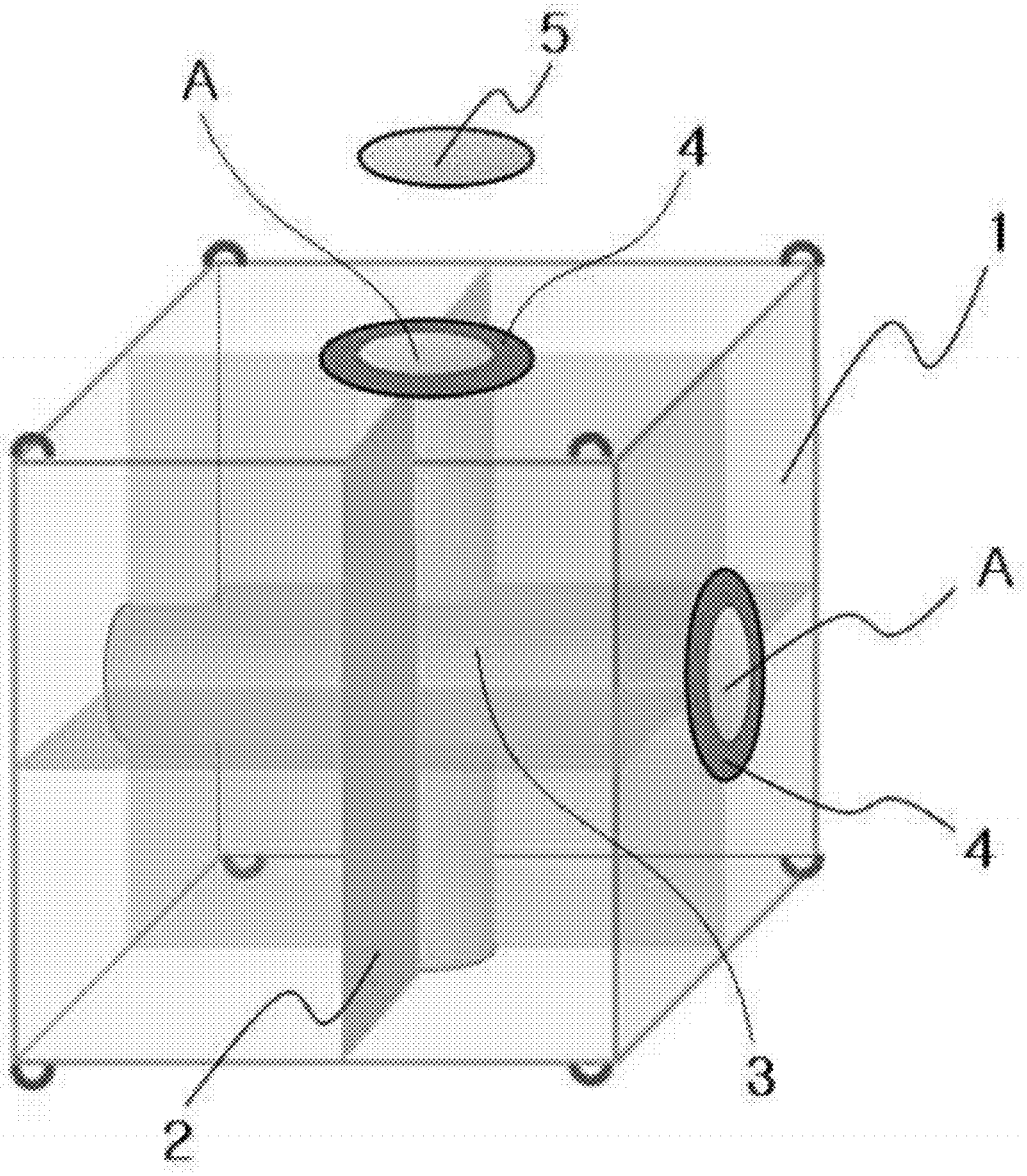
FIG. 1 shows a configuration of a modular RCS and IR signal generation device in accordance with an embodiment of the present invention.

Hereinafter, a preferred embodiment of the present invention will be described with reference to the accompanying drawings. In the following description and drawings, the same reference numerals are used to designate the same or similar components, and so repetition of the description on the same or similar components will be omitted.

1. Modular RCS and IR Signal Generation Device

FIG. 1 shows a configuration of a modular RCS and IR signal generation device in accordance with an embodiment of the present invention.

As deception methods for deterring threats so as to enhance the safety of a naval vessel, there are known a method of controlling signals of a naval vessel in terms of stealth, and a method of deceiving intimidation weapon systems with chaff, flares or the like. Since modern detection systems and intimidation weapon systems have been improved to such a level that they can discriminate the strength and position of RCS and IR signals according to a movement direction and a high angle of a naval vessel, it is necessary to make the RCS and IR signals of a decoy vessel most similarly simulate those of a naval vessel to be protected in order to obtain the best deception effect.

The inventive modular RCS and IR signal generation device has been conceived in consideration of this necessity, and includes a plastic bag 1, a radar reflector 2, hot air tubes 3, and connection patches 4. Hereinafter, each of these components will be described in detail.

Plastic Bag

The plastic bag 1 is normally stored in a folded state, and expanded if gas, such as air, is introduced into the plastic bag 1 as desired.

The plastic bag 1 encloses the radar reflector 2 so as to prevent any stimulus from being transferred to the outside, wherein the stimulus may be caused when the reflector 2 reflects solar light. However, the plastic bag 1 shall not influence the function of the radar reflector 2 even though it encloses the radar reflector 2.

Preferably, the plastic bag 1 has a regular hexahedron or rectangular parallelopiped shape as shown in FIG. 1. This is to make it easy to connect a plurality of such plastic bags 1 lengthwise and/or crosswise when it is desired to combine a plurality of the inventive modular RCS and IR signal generation devices so as to simulate the RCS and IR signal reflection patterns of a naval vessel to be protected (this will be described later).

If the plastic bag 1 is filled with gas, such as helium, it is also possible to use the inventive RCS and IR signal generation device in a state in which the plastic bag 1 is floated over a predetermined height and towed by a naval vessel or the like.

Radar Reflector

Figure 3:
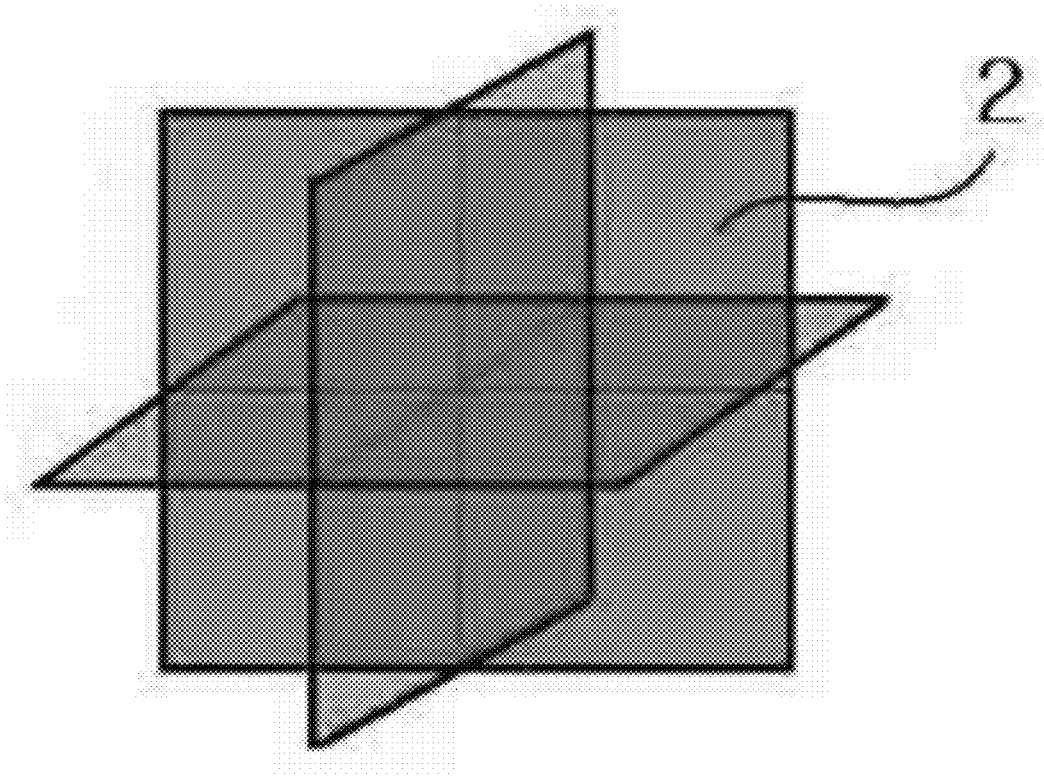
FIG. 3 shows an example of a shape of a radar reflector having a multihedral structure.

The radar reflector 2 is received within the plastic bag 1, and when the plastic bag 1 is inflated, the radar reflector 2 forms a multihedral structure (FIG. 3) within the plastic bag 1, which has a reflection characteristic similar to a naval vessel to be protected.

Preferably, the radar reflector 2 is a di-hedral or tri-hedral structure which can maximize its RCS (Radar Cross Section).

In general, the reflection characteristic of the radar reflector 2 may be expressed by RCS (0), wherein the RCS is a ratio of a radar's signal power projected to a surface of an object to a signal power back-scattered toward the radar, which is a value determined by quantifying how an object reflects or scatters radar signals. Although the quantitative value of RCS is important for the radar reflector 2, orientation is also an important factor. That is, if an object scatters radar signals only in a predetermined direction, the probability the object being detected by a ship radar, an airplane radar and/or a land radar is relatively reduced, whereas if an object scatters radar signals in every direction, the probability the object being detected is relatively increased.

Figure 4:
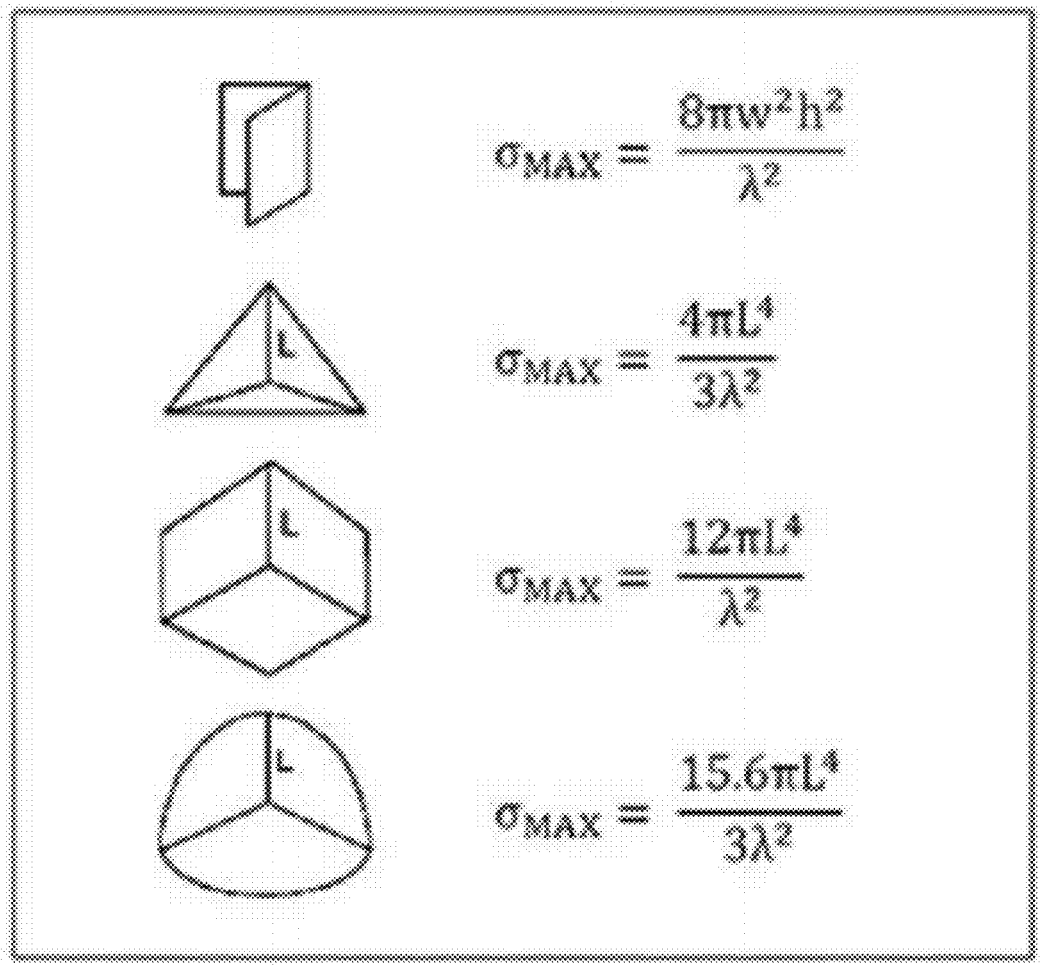
FIG. 4 shows radar cross section (0) calculation equations in accordance with reflector shapes.
Figure 5:
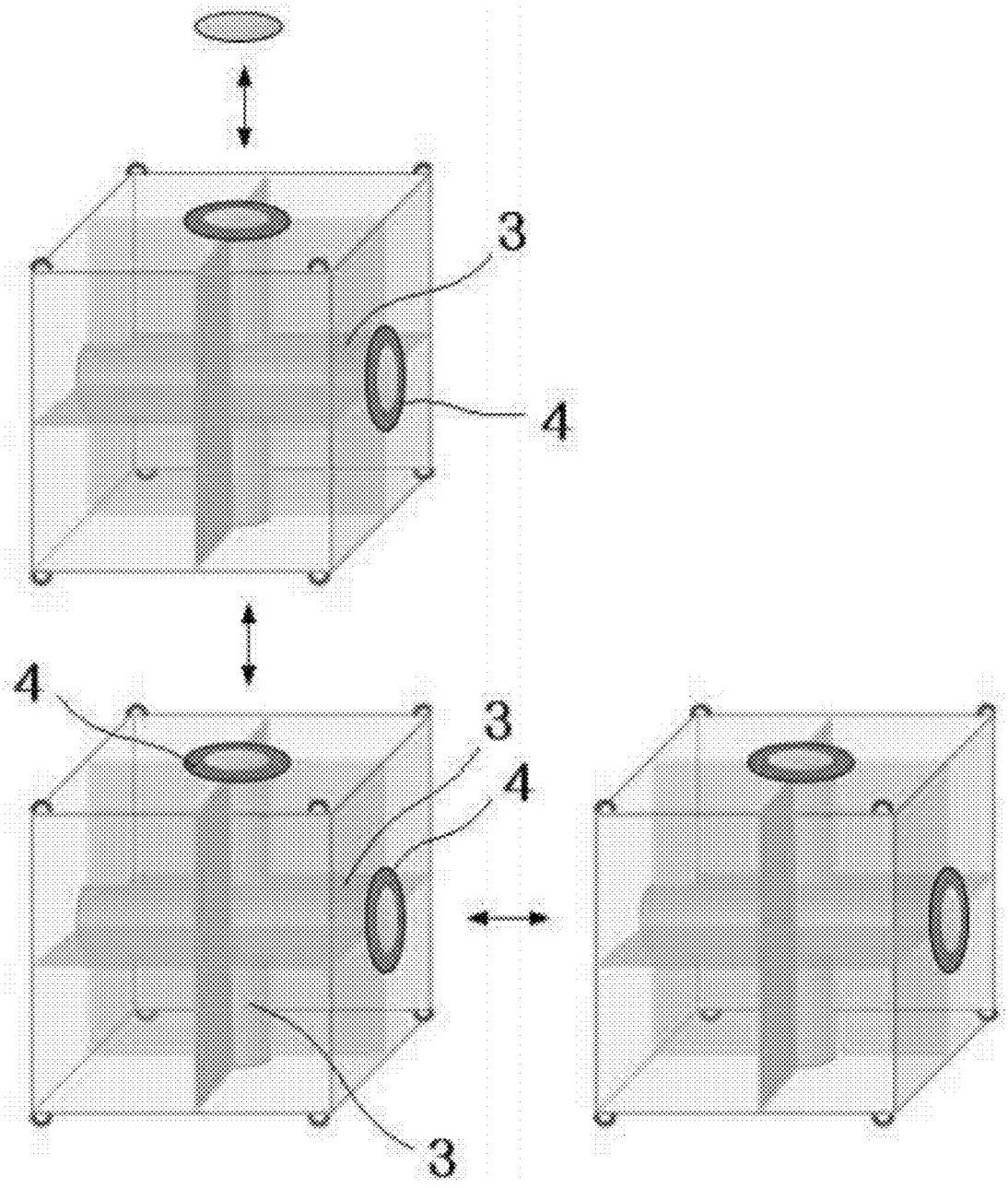
FIG. 5 shows a process of continuously connecting and combining the inventive modular RCS and IR signal generation devices lengthwise and crosswise.

Consequently, the reflection characteristic of the radar reflector 2 depends on the shape and RCS (0) of the radar reflector 2. Therefore, in order to make the radar reflector 2 have a reflection characteristic similar to that of a naval vessel to be protected, it is desired that the shape and RCS obtained by combining the radar reflectors 2 are similar to those of the naval vessel to be protected. FIG. 4 shows RCS (0) calculation equations in terms of the shapes of the radar reflector.

Hot Air Tubes

Hot air tubes 3 are formed through the plastic bag 1. Referring to the example of FIG. 1, the hot air tubes 3 extend through the central part of the regular hexahedron or rectangular parallelopiped plastic bag 1 lengthwise and crosswise. In such a case, the plastic bag 1 forms a sealed space in the remaining area excluding the hot air tubes 3, wherein the radar reflector 2 is positioned within the sealed space.

Hot air flows through the hot air tubes 3, and generates IR signals.

Connection Patches

As shown in FIG. 1, the connection patches 4 are positioned on the surfaces of the plastic bag 1 at the ends A of the hot air tubes 3, respectively.

The connection patches 4 should have adhesive force allowing the patches to be adhered to one another, wherein each of the connection patches 4 may be prepared in an adhesive type, but preferably prepared in a Velcro strip type. This is because not only can Velcro strips be easily attached and detached, but also they are not deteriorated in terms of adhesive force even if they are repeatedly attached and detached, and do not leave foreign substances or residue in the course of being attached or detached, whereby they can be easily controlled.

Figure 2:
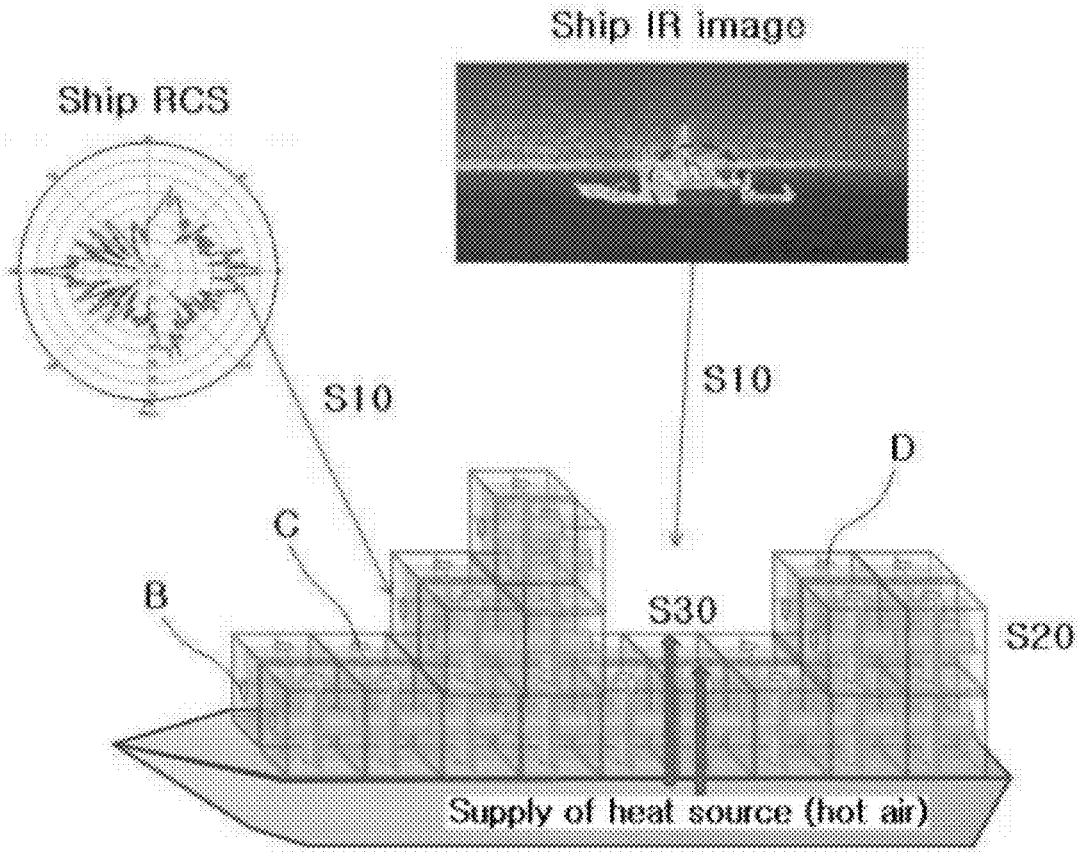
FIG. 2 is a schematic view showing a method of deceiving a threat using the inventive modular RCS and IR signal generation device.

A plurality of the inventive modular RCS and IR signal generation devices (hereinafter, referred to as "modular devices") can be interconnected and combined via the connection patches 4. That is, a worker may continuously connect and combine a plurality of modular devices lengthwise and crosswise by adhering the connection patches 4 to one another in such a manner that the hot air tubes 3 are also interconnected without discontinuation. The connection patches 4 can strengthen the connections between the modular devices by being attached in the above-mentioned manner, and prevent hot air from leaking from any connection parts of the interconnected hot air tubes 3. FIG. 2 shows a plurality of modular devices interconnected and combined with each other via the connection patches 4 on a decoy vessel.

Patch Covers

The present invention may further include cover patches which allow the opening or closing of the ends of the hot air tubes 3, respectively.

More specifically, the patches 5 can open or close the ends A of the hot air tubes 3 by being attached to the connection patches 4, respectively. That is, if a patch cover 5 is attached to a connection patch 4 in the embodiment of FIG. 1, the corresponding end of a hot air tube 3 is closed, whereas if the patch cover 5 is detached from the connection part 4, the corresponding end of the hot air tube 3 is opened.

In order for the patch covers 5 to perform such a function, each of the patch covers 5 should have adhesive force allowing it to be attached to any of the connection patches 4, wherein the connection patches 4 may be prepared in an adhesive type but preferably prepared in a Velcro strip type due to the reasons as described above.

The reason why the present invention further includes the cover patches 5 as described above is to block the leakage of hot air to the outside when it is desired to interconnect and combine a plurality of modular devices on a decoy vessel as shown in FIG. 2 and to introduce hot air into the hot air tubes 3 in the interconnected and combined state so as to simulate an IR signal emission pattern of a vessel to be protected. That is, if hot air is supplied in a state in which the ends B, C, D, etc. of the hot air tubes exposed to the outside as shown in FIG. 2 are not blocked by the patch covers 5, respectively, the hot air may be discharged to the outside through the ends, and the hot air discharged thereby will also form an IR signal emission pattern corresponding to the flow of the hot air, which causes an IR signal emission pattern to be formed that is substantially and entirely different from the IR signal emission pattern initially intended for the vessel to be protected, whereby no deception effect can be achieved.

2. a Method of Deceiving a Threat to Reduce the Susceptibility of a Naval Vessel Using a Modular RCS and IR Signal Generation Device FIG. 2 is a schematic view showing a threat deception method to reduce the susceptibility of a naval vessel using the inventive modular RCS and IR signal generation device. Hereinafter, the present invention will be described.

The present invention includes: analyzing RCS signal and IR signal emission patterns of a naval vessel to be protected (S10); combining a plurality of modular RCS and IR signal generation devices as described above to simulate an RCS signal emission pattern of the naval vessel to be protected (S20); and introducing hot air through the hot air tubes 3 to simulate an IR signal emission pattern of the naval vessel to be protected (S30).

In step S20, the combined shape and RCS of the radar reflectors 2 become similar to those of the naval vessel to be protected, and in step S30, hot air is introduced into the hot air tubes 3 in such a manner that the temperature of the hot air in a hot air tube is different from that of the hot air in other hot air tube so as to simulate the IR signal emission pattern of the naval vessel to be protected which has different characteristics from part to part.

As described above, recently developed intimidation weapon systems frequently use an IR sensor and a radar cross section (RCS) sensor simultaneously. This is to pursue a naval vessel to be torpedoed and sunk by discriminating its shape, and then to strike a blow against an engine part to be most badly damaged in the naval vessel by using IR signals, such as waste heat, wherein with the technology of the prior art, it is impossible to deter a homing characteristic of an intimidation weapon system. The present invention is adapted to control the temperatures of one or more specific positions of a decoy system in accordance with an IR emission characteristic of a naval vessel to be protected by introducing hot air to the hot air tubes in such a manner that the temperature of the hot air in a hot air tube is different from that of the hot air in other hot air tubes. In addition, the RCS and IR signal emission characteristics of a naval vessel are varied depending on the positions of individual parts of the naval vessel, such as an engine room, a deck and a hangar, and an enemy's detection systems and intimidation weapon systems will analyze these characteristics to discriminate an object to strike a blow. Considering this, the present invention forms a decoy system which can completely reflect the characteristics of a naval vessel through the steps S20 and S30, which is basically different from the technology of the prior art having a characteristic of merely emitting high RCS and IR signals.

In the present invention, the ends of the hot air tubes 3 exposed to the outside are blocked in step S30 to prevent the hot air from flowing to the outside due to the reasons as described above.

The present invention is very efficient for protecting friendly forces from an enemy's detection and attack based on RCS and IR signals, and can deceive the enemy's detection and intimidation weapon systems very quickly and easily with a simple method of changing the combination of modular devices in accordance with previously analyzed RCS and IR signal characteristics even if a naval vessel has various RCS and IR signal characteristics.

The inventive device can be installed a rigid inflatable boat, which may be carried by a naval vessel, together with a naval vessel, the signals of which are simulated, and if gas, such as helium, is introduced into the plastic bag 1, the inventive device can be towed by a naval vessel or the like in a state in which the inventive device is floated over a predetermined height.

The present invention is a technology which can realize practical and economic values by being widely applied to shipbuilding and naval defense industries, since it is expected that the present invention can protect the naval core power from an enemy's detection and attack, and allow combat power to be fully maintained, thereby playing an important role in balancing power between military powers at a combat against an asymmetric power.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A modular RCS (Radar Cross Section) and IR (Infra-Red) signal generation device comprising:

a plastic bag which is normally stored in a folded state, and inflated when gas is introduced into the bag as desired;

a radar reflector received in the plastic bag, the radar reflector being configured in a multi-hedral reflector structure having a reflection characteristic similar to that of a naval vessel to be protected;

hot air tubes formed through the plastic bag, hot air being capable of generating IR signals by flowing through the hot air tubes; and connection patches positioned on one of the surfaces of the plastic bag at the points where the ends of the hot air tubes intersect with the surfaces, respectively, the connection patches being adapted to be attached to those of adjacent modular RCS and IR signal generation devices, respectively, so as to interconnect the hot air tubes with those of the adjacent modular RCS and IR signal generation devices.

2. The device as claimed in claim 1, further comprising patch covers which can open or close the ends of the hot air tubes, respectively.

3. The device as claimed in claim 1, wherein air is introduced into the plastic bag.

4. The device as claimed in claim 1, wherein helium gas is introduced into the plastic bag.

5. The device as claimed in claim 1, wherein the plastic bag has a regular hexahedron or rectangular parallelopiped shape in a state in which it is inflated.

6. The device as claimed in claim 1, wherein the plastic bag does not influence on the function of the radar reflector.

7. The device as claimed in claim 1, wherein the radar reflector has a di-hedral or tri-hedral structure that can maximize RCS (Radar Cross Section).

8. The device as claimed in claim 1, wherein each of the connection patches is prepared in a Velcro strip type.

9. The device as claimed in claim 2, wherein each of the patch covers is prepared in a Velcro strip type.

10. A method of deceiving a threat to reduce susceptibility of a naval vessel using a modular RCS and IR signal generation device, the method comprising:

analyzing RCS and IR signal emission patterns of a naval vessel to be protected (step S10);

combining a plurality of modular RCS and IR signal generation devices to simulate the RCS signal emission patterns of the naval vessel to be protected (step S20); and introducing hot air through hot air tubes to simulate the IR signal emission patterns of the naval vessel to be protected (step S30).

11. The method as claimed in claim 10, wherein in step S20, the combined shape and RCS of the radar reflectors are made to be similar to those of the naval vessel to be protected.

12. The method as claimed in claim 10, wherein in step S30, the hot air is introduced into the hot air tubes in such a manner that the temperature of the hot air in each tube is different from that in other tube so as to simulate the IR signal patterns of the naval vessel to be protected.

13. The method as claimed in claim 10, wherein in step S30, the ends of the hot air tubes exposed to the outside are blocked to prevent the hot air from flowing to the outside.

* * * * *